US008726686B2

(12) United States Patent
Yoon et al.

(10) Patent No.: US 8,726,686 B2
(45) Date of Patent: May 20, 2014

(54) ICE MAKING DEVICE AND REFRIGERATOR

(75) Inventors: Jong-Seok Yoon, Changwon (KR); Byeong-Gyu Kang, Changwon (KR)

(73) Assignee: LG Electronics Inc., Seoul (KR)

( * ) Notice: Subject to any disclaimer, the term of this patent is extended or adjusted under 35 U.S.C. 154(b) by 822 days.

(21) Appl. No.: 12/524,126

(22) PCT Filed: Jan. 4, 2008

(86) PCT No.: PCT/KR2008/000060
§ 371 (c)(1),
(2), (4) Date: Nov. 30, 2009

(87) PCT Pub. No.: WO2008/100018
PCT Pub. Date: Aug. 21, 2008

(65) Prior Publication Data

US 2010/0101261 A1 Apr. 29, 2010

(30) Foreign Application Priority Data

Feb. 12, 2007 (KR) ..... 10-2007-0014461

(51) Int. Cl.
*A23G 9/00* (2006.01)
*F25C 1/00* (2006.01)

(52) U.S. Cl.
USPC ..... 62/345; 62/353

(58) Field of Classification Search
USPC ..... 62/344, 340, 347, 420, 345, 353, 66; 249/58, 60, 69–71, 119–120, 127, 129, 249/163, 203; D15/90
See application file for complete search history.

(56) References Cited

U.S. PATENT DOCUMENTS

| | | | | | |
|---|---|---|---|---|---|
| 3,596,477 | A * | 8/1971 | Harley | 62/353 |
| 5,012,655 | A * | 5/1991 | Chatterton | 62/340 |
| 5,177,980 | A * | 1/1993 | Kawamoto et al. | 62/353 |
| 5,735,130 | A * | 4/1998 | Lee | 62/71 |
| 5,829,266 | A * | 11/1998 | Lyu | 62/353 |
| 6,161,390 | A * | 12/2000 | Kim | 62/72 |
| 2002/0014087 | A1 * | 2/2002 | Kwon | 62/340 |
| 2005/0241329 | A1 * | 11/2005 | Castrellon et al. | 62/340 |
| 2006/0032262 | A1 * | 2/2006 | Seo et al. | 62/340 |
| 2006/0117786 | A1 * | 6/2006 | Lee et al. | 62/351 |

FOREIGN PATENT DOCUMENTS

| | | | |
|---|---|---|---|
| JP | 05-296623 | A | 11/1993 |
| JP | 06-011228 | A | 1/1994 |
| JP | 06-185841 | A | 7/1994 |
| JP | 06-241626 | A | 9/1994 |
| JP | 2003-279221 | * | 2/2003 |

* cited by examiner

*Primary Examiner* — Allana Lewin
*Assistant Examiner* — Dawit Muluneh
(74) *Attorney, Agent, or Firm* — Birch, Stewart, Kolsch & Birch, LLP

(57) ABSTRACT

An ice-making device and a refrigerator having the ice-making device are provided. The ice-making device includes an ice-making housing defining a predetermined ice-making space therein, an ice tray rotatably installed in the ice-making space and provided with a plurality of ice-making grooves, and a protruding rib that is formed on the ice tray to prevent water from being splashed out of the ice-making grooves.

9 Claims, 3 Drawing Sheets

ICE MAKING DEVICE AND REFRIGERATOR

TECHNICAL FIELD

The present disclosure relates to a refrigerator. More particularly, the present disclosure relates to an ice making device and a refrigerator having the ice-making device.

BACKGROUND ART

Generally, a refrigerator is a home appliance that stores food at a low temperature. The refrigerator has a freezing compartment and a refrigerating compartment. An ice-making device for making ice is installed in one of doors of the freezing and refrigerating compartments. The ice-making device includes an ice tray in which the ice is substantially made and an ice bank for storing the ice made in the ice tray. The ice made in the ice tray is separated from the ice tray by manual or automatic twisting operation of the ice tray and stored in the ice bank. A user uses the ice by taking out the ice bank from the freezing/refrigerating compartment door.

The conventional ice-making device has the following drawbacks.

As the freezing/refrigerating compartment door is opened and closed by pivoting about an axis, centrifugal force is applied to water contained in the ice tray of the ice-making device. As a result, the water contained in the ice tray may be splashed outward and thus the freezing/refrigerating compartment door may be contaminated by the splashed water.

Furthermore, when the splashed water is frozen by freezing air, food stuffs stored in the refrigerator may be adhered to each other or to a portion of the refrigerator. Separation of the food stuffs is troublesome for the user.

DISCLOSURE OF INVENTION

Technical Problem

Embodiments provide an ice-making device that can minimize contamination during an ice-making process, thereby providing user convenience and a refrigerator having the ice-making device.

Embodiments also provide an ice-making device that can be reliably operated even when it is installed on a freezing compartment door that is frequently opened and closed by a user and a refrigerator having the ice-making device.

Technical Solution

In an embodiment, an ice-making device includes an ice-making housing defining a predetermined ice-making space therein; an ice tray rotatably installed in the ice-making space and provided with a plurality of ice-making grooves; and a protruding rib that is formed on the ice tray to prevent water from being splashed out of the ice-making grooves.

In another embodiment, an ice-making device includes an ice-making housing defining an ice-making space therein; at least one ice tray rotatably supported on the ice-making housing and extending across the ice-making housing in a front-rear direction; a plurality of ice-making grooves formed on the ice tray; a lever rotating a first side of the ice tray; and a protruding rib that is formed by extending upward from one of front and rear edges of the ice tray to prevent water from overflowing by outer force.

In still another embodiment, an ice-making device includes an ice-making housing defining a predetermined ice-making space therein; an ice tray provided with a plurality of ice-making grooves for storing water; a protruding rib that is formed on the ice tray to prevent water from being splashed out of the ice-making grooves; and a water-overflowing preventing member that selectively shield an edge of the ice tray when the ice tray is horizontally disposed.

In still yet another embodiment, a refrigerator includes a refrigerator door for selectively sealing a low temperature space; and an ice-making device installed on the refrigerator door, wherein the ice-making device includes an ice-making housing defining a space to which cool air is supplied from an external side and an ice tray disposed in the ice-making housing and rotatably supported on the ice-making housing; and the ice tray includes an ice-making groove for forming ice having a predetermined shape and a water-overflowing preventing member that is supported on the ice-making housing and contacts a top edge of the ice tray to prevent water stored in the ice-making groove from overflowing.

In still yet another embodiment, a refrigerator includes a refrigerator door for selectively sealing a low temperature space; and an ice-making device installed on the refrigerator door, wherein the ice-making device includes an ice-making housing defining a space to which cool air is supplied from an external side and at least two ice trays rotatably supported on the ice-making housing; and the ice tray includes a case provided with a plurality of ice-making grooves that are arranged in a longitudinal direction to make ice cubes each having a predetermined shape and a protruding rib extending upward from an end of the case to prevent water stored in the ice-making groove from overflowing when the refrigerator door moves, the protruding rib is formed on at least one edge of the case which is more upwardly protruded than other portion of the wall forming the case.

Advantageous Effects

According to the embodiments, contamination of the refrigerator can be minimized during operation of the ice-making device. In addition, the adhering of food stuffs around the ice-making device by water splashed from the ice-making device can be prevented.

BEST MODE FOR CARRYING OUT THE INVENTION

Reference will now be made in detail to the embodiments of the present disclosure, examples of which are illustrated in the accompanying drawings.

Figure 1:
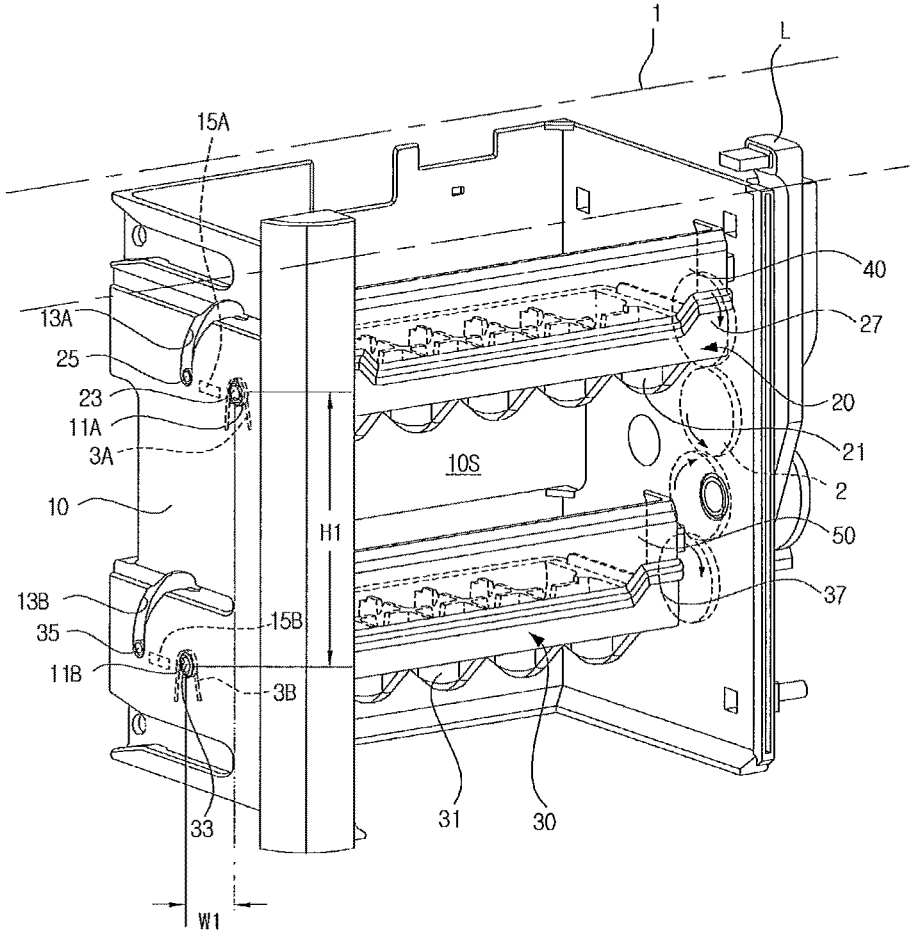
FIG. 1 is a perspective view of an ice-making device according to an embodiment.
Figure 2:
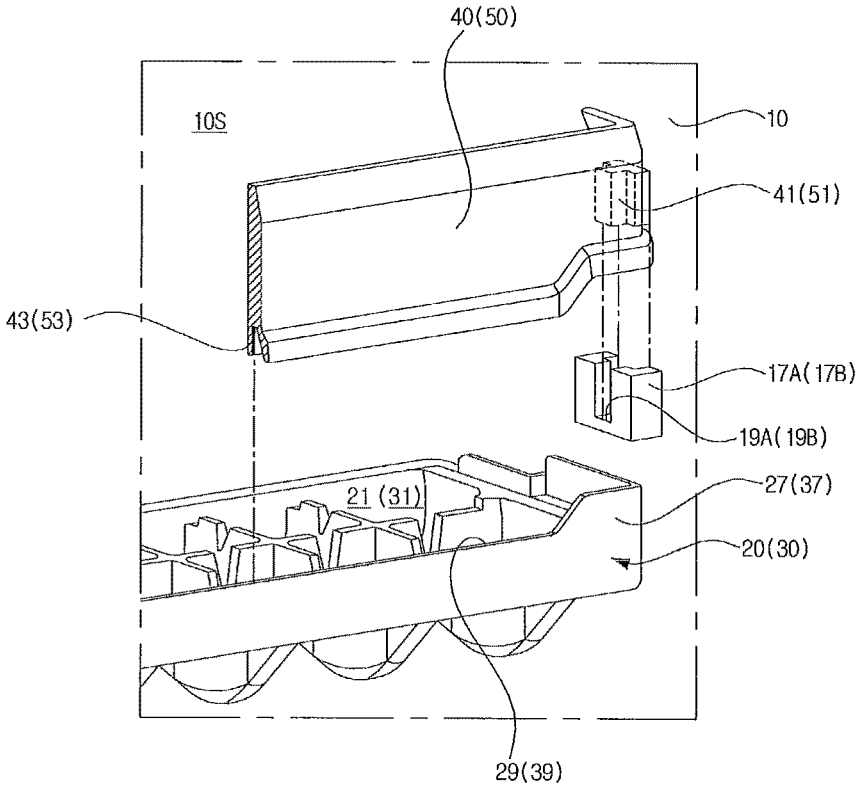
FIG. 2 is an exploded perspective view of major parts of the ice-making device of FIG. 1.

FIG. 1 is a perspective view of an ice-making device according to an embodiment and FIG. 2 is an exploded perspective view of major parts of the ice-making device of FIG. 1.

Referring to FIGS. 1 and 2, an ice-making housing 10 constituting an ice-making device is formed in a hexahedron structure having an opened top and an opened bottom. The ice-making housing 10 is detachably installed on an inner surface of a refrigerator door 1. An ice-making space 10S is defined in the ice-making housing 10.

A window (not shown) through which a user can see an inside of the ice-making space 10S is provided on a surface of the ice-making housing 10 that is exposed to an external side in a state where the refrigerator door is opened. The window may be formed of a transparent or translucent material. The window is provided with a cool air inlet (not shown) through which cool air is introduced into the ice-making space 105.

The ice-making housing 10 is provided at both side surfaces with a pair of rotational holes 11A and 11B for supporting ice trays 20 and 30 that will be described later. The paired rotational holes 11A and 11B are spaced apart from each other by predetermined distances in horizontal and vertical directions H1 and W1.

The ice-making housing 10 is provided at one of the side surfaces (i.e., a left side in FIG. 1) with a pair of guide slots 13A and 13B adjacent to the rotational holes 11A and 11B. The guide slots 13A and 13B are formed in a circular-arc shape having a predetermined central angle about the rotational holes 11A and 11B. In the embodiment, the guide slots 13A and 13B are formed in the circular-arc shape provided in the ice-making space 10S within a range of 0-90 in rectangular coordinates where the rotational holes 11A and 11B are origins when viewed from one side surface of the ice-making housing 10.

The ice-making housing 10 is provided at an inner surface of one of the side surfaces with a pair of tray stoppers 15A and 15B adjacent to the rotational holes 11A and 11B. The tray stoppers 15A and 15B function as supporting points at which the ice trays 20 and 30 are twisted by closely contacting sides of the ice trays 20 and 30.

A pair of insertion ribs 17A and 17B are provided above the respective tray stoppers 15A and 15B on respective inner surfaces of the both sides of the ice-making housing 10. The insertion ribs 17A and 17B protrude by a predetermined thickness from the inner surfaces of the both sides of the ice-making housing 10.

Each of the insertion ribs 17A and 17B has a □-shaped longitudinal section that is opened upward.

The insertion ribs 17A and 17B are provided with insertion grooves 19A and 19B, respectively. The insertion grooves 19A and 19B are provided to secure water-overflowing preventing members 40 and 50 that will be described later. Each of the insertion grooves 19A and 19B has a T-shaped cross-section that is opened upward.

The ice trays 20 and 30 are provided in the ice-making space 10S.

The ice trays 20 and 30 will be referred to as upper and lower ice trays 20 and 30 hereinafter. Each of the upper and lower ice trays 20 and 30 is formed in a hexahedron shape having a rectangular cross-section. The upper and lower ice trays 20 and 30 are provided with a plurality of ice making grooves 21 and 31 for making ice cubes.

The upper and lower ice trays 20 and 30 are rotatably installed in the ice-making space 10S. That is, each of the upper and lower ice trays 20 and 30 is provided with a pair of rotational shafts 23 (33). The rotational shafts 23 and 33 are provided on centers of short sides of the upper and lower ice trays 20 and 30. The rotational shafts 23 and 33 are inserted in the respective insertion holes 11A and 11B to function as rotational centers of the upper and lower ice trays 20 and 30. In a state where the upper and lower ice trays 20 and 30 rotate by a predetermined angle about the rotational shafts 23 and 33, they are twisted by being hooked on the respective tray stoppers 15A and 15B. That is, the right portion in FIG. 1 intends to rotate but the left portion in FIG. 1 is caught by the tray stopper 15A and 15B. As a result, the ice trays 20 and 30 are twisted.

Springs 3A and 3B are provided on the respective rotational shafts 23 and 33. When the upper and lower ice trays 20 and 30 are twisted about the rotational shafts 23 and 33 to separate the ice cubes, the springs 3A and 3B bias the respective upper and lower ice trays 20 and 30 toward their initial positions.

One of the short sides of the respective upper and lower ice trays 20 and 30 are provided with guide projections 25 and 35 adjacent to the respective rotational shafts 23 and 33. In this embodiment, the guide projections 25 and 35 are provided on the left side surfaces of the upper and lower ice trays 20 and 30. The guide projections 25 and 35 are respectively inserted in the guide slots 13A and 13B and moves along the respective guide slots 13A and 13B to guide the rotations of the upper and lower ice trays 20 and 30. Describing in more detail, the guide projections 25 and 35 are located at first ends of the guide slots 13A and 13B, where the coordinate is 0 with reference to the rotational holes 11A and 11B, in a state where the upper and lower ice trays 20 and 30 are horizontally disposed, i.e., where the upper and lower ice trays 20 and 30 are supported on the respective tray stoppers 15A and 15B. In this state, when the upper and lower ice trays 20 and 30 rotate, the guide projections 25 and 35 move along the respective guide slots 13A and 13B. The guide projections 25 and 35 are located at second ends of the respective guide slots 13A and 13B, where the coordinate with reference to the respective rotational holes 11A and 11B becomes 90°, when the upper and lower ice trays 20 and 30 are twisted by the respective tray stoppers 15A and 15B.

Protruding ribs 27 and 37 are provided on top surfaces of the upper and lower ice trays 20 and 30. The protruding ribs 27 and 37 are provided to prevent water contained in the ice-making grooves 21 and 31 of the respective upper and lower ice trays 20 and 30 from overflowing into the ice-making space 10S when the door 1 is opened and closed by pivoting.

In this embodiment, the protruding ribs 27 and 37 are formed extending from top corners of the upper and lower ice trays 20 and 30, which are adjacent to a surface of the ice-making housing 10, which is exposed frontward in a state where the door is open. That is, by forming the protruding ribs 27 and 37 at the corners of the upper and lower ice trays 20 and 30, at which the water frequently overflows during the pivoting of the door, the water overflowing can be effectively prevented. In a state where the door is open, the protruding ribs 27 and 37 may be also formed on a rear side, i.e., an opposite side of the top corner of each of the ice trays. As the door is repeatedly opened and closed, the centrifugal and inertia forces are applied in opposite directions. Therefore, it is preferable that the protruding ribs 27 and 37 are formed on the opposite sides of the upper and lower ice trays 20 and 30. Needless to say, it will be possible to form the protruding ribs 27 and 37 on entire top circumferences of the upper and lower ice trays 20 and 30.

Fixing protrusions 29 and 39 are provided on longitudinal top side edges of the upper and lower ice trays 20 and 30 between the protruding ribs 27 and 37. The fixing protrusions 29 and 39 are formed extending from portions of the protruding ribs 27 and 37 and the longitudinal top side edges of the upper and lower ice trays 20 and 30.

Meanwhile, the pair of water-overflowing preventing members 40 and 50 are provided in the ice-making space 10S. Like the protruding ribs 27 and 37, the water-overflowing preventing members 40 and 50 are provided to prevent the water contained in the ice-making grooves 21 and 31 from overflowing into the ice-making space S. The water-overflowing preventing members 40 and 50 corresponding to the upper and lower ice trays 20 and 30, respectively, will be referred to as first and second water-overflowing preventing members.

Each of the first and second water-overflowing preventing members 40 and 50 is generally formed having a □-shaped cross-section. At this point, a lower end of each of the first and second water-overflowing preventing members 40 and 50 are formed having a shape corresponding to a shape of the protruding ribs 27 and 37 and the longitudinal top edges of the first and second ice trays 20 and 30 between the protruding ribs 27 and 37. Insertion protrusions 41 and 51 are provided corresponding to the protruding ribs 27 and 37. The insertion protrusions 41 and 51 protrude outward from the both side surfaces of the first and second water-overflowing preventing members 40 and 50. The insertion protrusions 41 and 51 are inserted into the insertion grooves 19A and 19B in a state where the first and second water-overflowing preventing members 40 and 50 are installed in the ice-making space 10S. To this end, the insertion protrusions 41 and 51 are formed having a T-shaped cross-section corresponding to the insertion grooves 19A and 19B. The insertion protrusions 41 and 51 are inserted into the insertion grooves 19A and 19B by being moved downward.

Fixing grooves 43 and 53 are formed on lower ends of the first and second water-overflowing preventing members 40 and 50. The fixing grooves 43 and 53 are formed by partly depressing the lower ends of the first and second water-overflowing preventing members 40 and 50. The fixing protrusions 29 and 39 are selectively inserted into the fixing grooves 43 and 53 when the upper and lower ice trays 20 and 30 rotate.

A lever L and a plurality of gears 2 are provided on a right outer surface of the ice-making housing 10 to twist the ice trays 20 and 30. To this end, the lever L is installed such that an upper end thereof can pivot about a lower end thereof. The gears 2 function to transmit torque of the lever L to the ice trays 20 and 30. To transmit the torque, the gears 2 are connected to the rotational shafts 23 and 33 of the ice trays 20 and 30.

Although not shown in the drawings, a water tank and an ice bank may be respectively provided above and under the ice making housing on an inner surface of the door. The water tank stores the water that will be supplied to the upper and lower ice trays 20 and 30. The ice bank stores the ice cubes that are separated from the upper and low ice trays 20 and 30 as the ice trays 20 and 30 are twisted. The water tank and the ice bank are detachably mounted on the inner surface of the door. The ice bank is installed to be capable of being taken in and out through a home bar.

The following will describe a process for making ice according to the embodiment.

Figure 3:
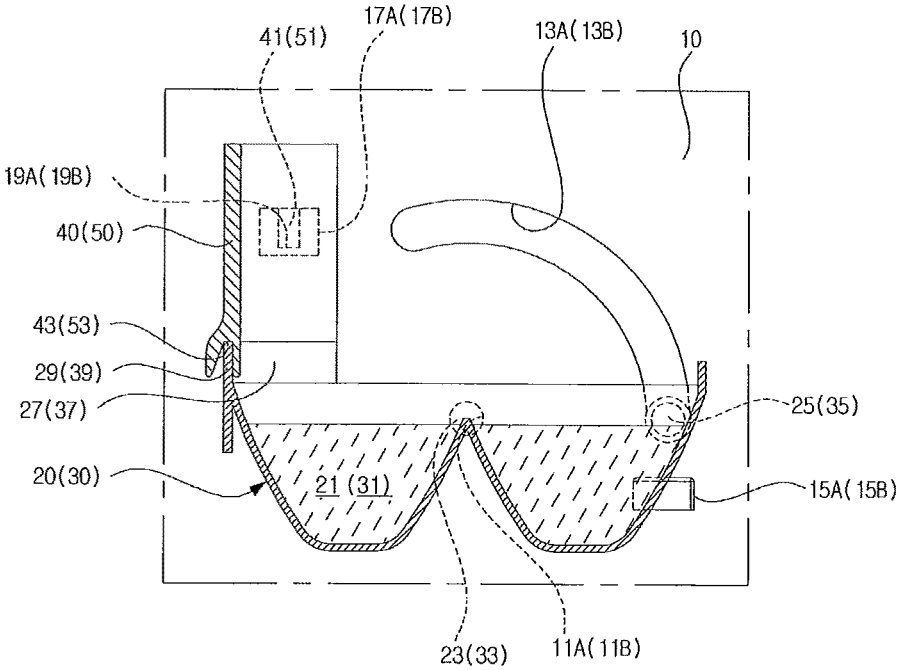
FIGS. 3 through 5 illustrate a process for making ice and separating ice from the ice-making device of FIG. 1.
Figure 4:
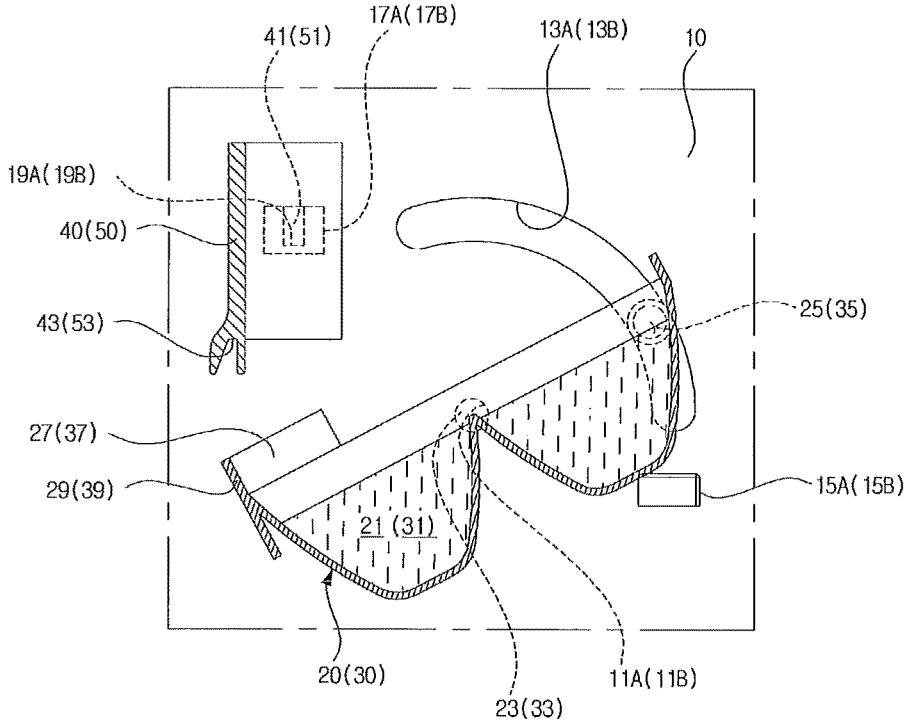
Figure 5:
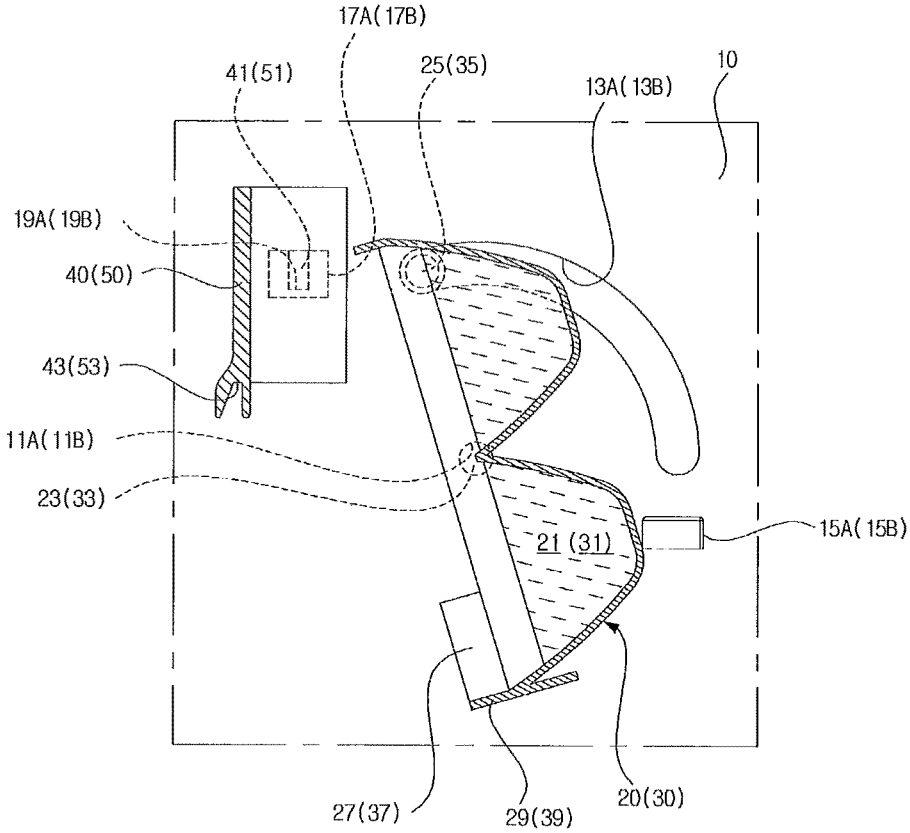

FIGS. 3 through 5 show a process for making and separating ice according to the embodiment of FIG. 1.

Referring first to FIG. 3, water is supplied from the water tank into the ice-making grooves of the upper and lower ice trays 20 and 30 in a state where the upper and lower ice trays 20 and 30 are horizontally disposed. The water supplied into the ice-making grooves 21 and 31 of the upper and lower ice trays 20 and 30 are frozen by freezing air flowing in the freezing compartment of the refrigerator.

Meanwhile, if the door is opened by pivoting during the water supply to the upper and lower ice trays 20 and 30 or before the water contained in the ice-making grooves 21 and 31 of the upper and lower ice trays 20 and 30 are frozen, the water may overflow out of the ice-making grooves 21 and 31 of the upper and lower ice trays 20 and 30. However, the overflowing of the water can be prevented by the protruding ribs 27 and 37 and the first and second water-overflowing preventing members 40 and 50. Therefore, the contamination of the ice making space 10S of the ice-making housing by the overflowing water can be prevented during the water supply to the upper and lower ice trays 20 and 30 or the ice-making process in the upper and lower ice trays 20 and 30.

As shown in FIG. 4, when the water contained in the ice-making grooves 21 and 31 of the upper and lower ice trays 20 and 30 are frozen into ice cubes, the upper and lower ice trays 20 and 30 are twisted to separate the ice cubes therefrom. That is, when the lever L is pulled downward, the gears 2 connected to the lever rotate. Therefore, the upper and lower ice trays 20 and 30 connected to the respective gears 2 rotate counterclockwise abut the respective rotational shafts 23 and 33 in FIG. 3. At this point, the guide protrusions 25 and 35 positioned at the first ends of the guide slots 13A and 13B move along the guide slots 13A and 13B.

When the upper and lower ice trays 20 and 30 rotate as described above, the fixing protrusions 29 and 39 of the upper and lower ice trays 20 and 30 are separated from the fixing grooves 43 and 53 of the first and second water-overflowing preventing members 40 and 50. However, since the insertion protrusions 41 and 51 of the first and second water-overflowing preventing members 40 and 50 are supportably inserted in the insertion grooves 19A and 19B, the first and second water-overflowing preventing members 40 and 50 do not rotate even when the upper and lower ice trays 20 and 30 rotate.

As shown in FIG. 5, when the upper and lower ice trays 20 and 30 keep rotating counterclockwise in the drawings, the first sides of the upper and lower ice trays 20 and 30 closely contact the tray stoppers 15A and 15B. In this state, when the level L is further pulled downward, the upper and lower ice trays 20 and 30 are twisted. Therefore, the ice cubes are separated from the upper and lower ice trays 20 and 30.

When the force for rotating or twisting the upper and lower ice trays 20 and 30, i.e., the force for pulling the lever L downward, is released, the upper and lower ice trays 20 and 30 are returned to their initial positions by elastic force of the springs. That is, the first sides of the upper and lower ice trays 20 and 30 are supported by the tray stoppers 15A and 15 to maintain the horizontal states.

The ice cubes separated from the upper and lower ice trays 20 and 30 are stored in the ice bank. The user can use the ice cubes by taking out the ice bank through, for example, the home bar.

Meanwhile, it may be considered that the protruding rib may be formed on an entire edge of each of the ice trays. In this case, the protruding rib, however, may interfere with the separation of the ice cubes from the ice trays. Furthermore, since the water most frequently overflows at the left and right side ends of each of the ice trays, the protruding rib on left and right side ends of each of the ice trays is formed on the left and right side ends in this embodiment.

In another embodiment, only the protruding ribs may be provided but the water-overflowing preventing members are not provided. In this case, the over-overflowing caused by opening/closing the door may be prevented. However, since there is still possibility of the water-overflowing, it is preferable to form the water-overflowing preventing members as well as the protruding members as described in the foregoing embodiment.

In still another embodiment, only the over-flowing preventing members are provided but the protruding members are not provided. In this case, since the water may slightly overflow through a contacting portion between the water-overflowing preventing member and the ice tray when the door is opened and closed. Therefore, it is preferable to form the water-overflowing members as well as the protruding members as described in the foregoing embodiment.

Although embodiments have been described with reference to a number of illustrative embodiments thereof, it should be understood that numerous other modifications and embodiments can be devised by those skilled in the art that will fall within the spirit and scope of the principles of this disclosure.

INDUSTRIAL APPLICABILITY

According to the embodiments, the overflowing of the water contained in the ice-making grooves of the ice trays can be prevented when the door of the refrigerator is opened and closed. Therefore, the user can more hygienically use the refrigerator.

The invention claimed is:

1. An ice-making device comprising:

an ice-making housing mounted on a door, the ice-making housing comprising:
- a first side wall;
- a second side wall;
- a rear wall connecting the first side wall to the second side wall;
- a first hole provided on the first side wall;
- a second hole provided on the second side wall;
- a guide slot provided on the first side wall; and
- a water-overflowing preventing member mounted to the first and second side walls and having an extending plate provided between the first side wall and the second side wall, a fixing groove being provided on a bottom portion of the extending plate; and an ice tray comprising:
- an ice tray body having a plurality of ice-making grooves for making ice;
- a first shaft coupled to the first hole and a second shaft coupled to the second hole;
- a guide protrusion inserted in the guide slot for twisting the ice tray such that ice generated in the plurality of ice-making grooves are capable of being removed from the plurality of ice-making grooves; and
- an extending rib that is formed on a top portion of the ice tray, the extending rib being selectively inserted in the fixing groove of the extending plate; and an ice tray driving part provide at the second side wall and connected to the second shaft, wherein the water-overflowing preventing member is detachably mounted on the first and second side walls of ice-making housing, wherein the extending rib comprises a first portion provided on a corner of the ice tray and a second portion, a height of the first portion being greater than a height of the second portion, the first and second portions extending upwardly from the ice tray body, wherein the fixing groove comprises a first fixing groove in which the first portion is inserted and a second fixing groove in which the second portion is inserted, and wherein the first fixing groove is provided on a corner of the extending plate, the first fixing groove located higher than the second fixing groove.

2. The ice-making device according to claim 1, wherein the extending rib is inserted in the fixing groove of the extending plate in a state which the ice tray is horizontally arranged.

3. The ice-making device according to claim 1, wherein each first and second side wall comprises a coupling part to which the water-overflowing preventing member is detachably coupled.

4. The ice-making device according to claim 1, wherein if the ice tray is divided into a first part and a second part with respect to the first shaft, the extending is provided on the first part and the water-overflowing preventing member is provided at an upper side of the extending rib.

5. The ice-making device according to claim 1, further comprising a tray stopper provided on one of the first and second side walls to stop rotation of the ice tray.

6. The ice-making device according to claim 1, wherein at least two ice trays are provided and the ice trays are spaced apart from each other in a vertical direction.

7. The ice-making device according to claim 6, further comprising a lever provided to simultaneously rotate the ice trays.

8. An ice-making device comprising:

an ice-making housing mounted on a door, the ice-making housing comprising:
- a first side wall;
- a second side wall;
- a rear wall connecting the first side wall to the second side wall;
- first and second holes provided on the first side wall;
- third and fourth holes provided on the second side wall;
- first and second guide slots provided on the first side wall;
- first and second water-overflowing preventing members each mounted to the first and second side walls, each water-overflowing preventing member having an extending plate provided between the first side wall and the second side wall, and a fixing groove being provided on a bottom portion of each extending plate;

a first ice tray comprising:
- a first ice tray body having a plurality of ice-making grooves for making ice;
- a first shaft coupled to the first hole and a second shaft coupled to the third hole;
- a first guide protrusion inserted in the first guide slot for twisting ice tray such that ice generated in the plurality of ice-making grooves are capable of being removed from the plurality of ice-making grooves; and
- a first extending rib formed on a top portion of the first ice tray, the first extending rib being selectively inserted in the fixing groove of the extending plate of the first water-overflowing preventing member; and a second ice tray comprising:
- a second ice tray body having a plurality of ice-making grooves for making ice;
- a third shaft coupled to the second hole and a fourth shaft coupled to the fourth hole;
- a second guide protrusion inserted in the second guide slot for twisting ice tray such that ice generated in the plurality of ice-making grooves are capable of being removed from the plurality of ice-making grooves; and
- a seconding extending rib that is formed on a top portion of the second ice tray, the second extending rib being selectively inserted in the fixing groove of the extending plate of the second water-overflowing preventing member; and an ice tray driving part provide at the second side wall and connected to the second shaft, wherein the first shaft and the third shaft are spaced apart from each other in vertical and horizontal directions, and the first and second water-overflowing preventing members are spaced apart from each other in vertical and horizontal directions, wherein each of the first and second extending ribs comprises a first portion provided on a corner of the ice tray and a second portion, the first and second portion of each of the first and second extending ribs extending upwardly from the first and second ice tray bodies, respectively, a height of the first portion being greater than a height of the second portion, wherein the fixing groove comprises a first fixing groove in which the first portion is inserted and a second fixing groove in which the second portion is inserted, and wherein the first fixing groove is provided on a corner of the extending plate, the first fixing groove located higher than the second fixing groove.

9. An ice-making device comprising:

an ice-making housing mounted on a door, the ice-making housing comprising:

a first side wall;

a second side wall;

a rear wall connecting the first side wall to the second side wall;

a first hole provided on the first side wall;

a second hole provided on the second side wall;

a guide slot provided on the first side wall;

a water-overflowing preventing member mounted to the first and second side walls and having an extending plate provided between the first side wall and the second side wall, and a fixing groove being provided on a bottom portion of the extending plate; and an ice tray comprising:

an ice tray body having a plurality of ice-making grooves for making ice;

a first shaft coupled to the first hole and a second shaft coupled to the second hole;

a guide protrusion inserted in the guide slot for twisting the ice tray such that ice generated in the plurality of ice-making grooves are capable of being removed from the plurality of ice-making grooves; and an extending rib that is formed on a top portion of the ice tray, the extending rib being selectively inserted in the fixing groove of the extending plate; and an ice tray driving part provided at the second side wall and connected to the second shaft, wherein the water-overflowing preventing member is detachably mounted on the first and second side walls of ice-making housing, wherein the extending rib comprises a first portion provided on a corner of the ice tray and a second portion, a height of the first portion being greater than a height of the second portion, the first and second portions extending upwardly from the ice tray body, wherein the fixing groove comprises a first fixing groove in which the first portion is inserted and a second fixing groove in which the second portion is inserted, wherein the first fixing groove is provided on a corner of the extending plate, the first fixing groove located higher than the second fixing groove, and wherein the first portion comprises a first element and a second element horizontally bent from the first element.

* * * * *